US010816284B2

(12) United States Patent
Jackson

(10) Patent No.: US 10,816,284 B2
(45) Date of Patent: Oct. 27, 2020

(54) CLEANING INSTALLATION FOR CLEANING A HEAT EXCHANGER

(71) Applicant: EUGENE B, Paris (FR)

(72) Inventor: Philip Eugene Douglas Jackson, Paris (FR)

(73) Assignee: EUGENE B, Paris (FR)

( * ) Notice: Subject to any disclaimer, the term of this patent is extended or adjusted under 35 U.S.C. 154(b) by 35 days.

(21) Appl. No.: 16/015,648

(22) Filed: Jun. 22, 2018

(65) Prior Publication Data

US 2018/0372433 A1 Dec. 27, 2018

(30) Foreign Application Priority Data

Jun. 23, 2017 (FR) ..... 17 55778

(51) Int. Cl.

| | |
|---|---|
| ***F28G 1/12*** | (2006.01) |
| ***B08B 9/057*** | (2006.01) |
| ***B08B 9/055*** | (2006.01) |
| ***F28G 1/00*** | (2006.01) |

(52) U.S. Cl.

CPC ..... *F28G 1/12* (2013.01); *B08B 9/057* (2013.01); *B08B 9/0551* (2013.01); *B08B 9/0552* (2013.01); *B08B 2209/055* (2013.01); *F28G 1/00* (2013.01)

(58) Field of Classification Search

CPC ..... F28F 1/22; F28F 1/426; B21C 37/151; B21C 1/24; F16L 9/22; F28G 1/12; F28G 1/00; B08B 9/057; B08B 9/0551; B08B 9/0552

USPC ..... 165/95; 15/3.51; 29/890.036, 890.038

See application file for complete search history.

(56) References Cited

U.S. PATENT DOCUMENTS 2,177,429 A * 10/1939 Foster ..... D21F 1/34 15/104.061
2,839,768 A * 6/1958 Suchecki ..... B08B 9/057 15/3.51
3,021,546 A * 2/1962 Walz ..... B08B 9/057 15/3.51
3,215,195 A * 11/1965 Friedrich ..... F28G 1/12 165/95

(Continued)

FOREIGN PATENT DOCUMENTS

| | | |
|---|---|---|
| CN | 103712513 | 4/2014 |
| JP | 2001272199 | 10/2001 |
| WO | 2005/124261 | 12/2005 |

OTHER PUBLICATIONS

International Search Report dated Feb. 19, 2018.

*Primary Examiner* — Paul Alvare
(74) *Attorney, Agent, or Firm* — Ipsilon USA, LLP

(57) ABSTRACT

A cleaning installation of a heat exchanger includes a heat exchanger linked upstream to an intake duct for a fluid and downstream to an outlet duct for the fluid. A system is provided for recovering cleaning bodies from the outlet duct after cleaning of the exchanger by the bodies and for reinjecting bodies into the intake duct. The system includes a member capable of being displaced between a first position in which the system is configured to recover and contain cleaning bodies in the mobile member, and a second position in which the system is configured to take fluid from the intake duct and reinject, into this duct, via the mobile member and under the action of the fluid taken, cleaning bodies contained in the member.

10 Claims, 4 Drawing Sheets

(56) References Cited

U.S. PATENT DOCUMENTS 3,919,732 A * 11/1975 Honma ..... F28G 1/12 15/3.51
4,127,160 A * 11/1978 Joffe ..... F01P 11/06 134/169 A
4,176,708 A * 12/1979 Joffe ..... F01P 11/06 123/41.01
4,295,519 A * 10/1981 Bellaff ..... F28G 1/00 165/11.1
4,554,965 A 11/1985 Bochhiski et al.
4,566,533 A * 1/1986 Bochinski ..... F28G 1/12 134/8
4,578,838 A * 4/1986 Prinz ..... F28G 1/12 15/104.062
4,620,589 A * 11/1986 Koller ..... F28G 1/12 15/3.51
4,688,630 A * 8/1987 Borchert ..... F28G 1/12 15/104.063
4,694,892 A * 9/1987 Borchert ..... F28G 1/12 15/104.062
4,865,121 A * 9/1989 Ben-Dosa ..... F28G 1/12 165/95
4,984,629 A * 1/1991 Voith ..... F28G 1/12 15/3.5
5,072,476 A * 12/1991 Bersch ..... B08B 9/0551 15/104.063
5,095,572 A * 3/1992 Wagner ..... B08B 9/0551 137/242
5,176,204 A * 1/1993 Ben-Dosa ..... F28G 1/12 15/3.51
5,680,665 A * 10/1997 Anson ..... B08B 9/057 15/3.51
8,943,633 B2 * 2/2015 Soh ..... B08B 9/055 15/3.51
2006/0179588 A1 * 8/2006 Walters ..... B08B 9/0551 15/3.51

* cited by examiner

CLEANING INSTALLATION FOR CLEANING A HEAT EXCHANGER

RELATED APPLICATION

This application claims the benefit of priority from French Patent Application No. 17 55778, filed on Jun. 23, 2017, the entirety of which is incorporated by reference.

BACKGROUND

Field of the Invention

The present invention relates to a heat exchanger cleaning installation.

Description of Related Art

As is known, tubular heat exchangers have an efficiency which depends on the coefficient of heat exchange through the wall of the tubes. Over time, the internal surface of the tubes of the tube bundle which are passed through by the coolant are subject to fouling which can take the form of scaling, silt deposits, a film of biological growths or a combination thereof.

To avoid this fouling which impacts the energy efficiencies of such an exchanger, balls made of foam rubber, which have a density equal to that of water once the air contained in the foam is eliminated, are passed into the tubes. These balls have a diameter slightly greater than the internal diameter of the tube in order to ensure sufficient ball/tube friction to wipe the internal surface of the tube. The quantity of balls in the circuit is a fraction of the number of tubes of the exchanger. The frequency of passage necessary for the balls to ensure the cleanliness of the tubes is generally at least one pass per day per tube.

The balls are injected into the cooling water duct immediately upstream of the exchanger inlet. The balls run in the tubes and clean them, propelled in the tubes by the hydraulic force created by the flow load loss of the water in the tube bundle. The balls re-emerge through the reheated water discharge duct. A device that is known per se (generally an inclined grating installed through the duct) intercepts and collects the balls. These balls are then extracted to a device for managing said balls which generally comprises at least one pump and a storage airlock. The balls can be either stopped and stored in the airlock, or returned upstream of the exchanger for a new cleaning. The pump is a special model which makes it possible not to damage the balls. This pump is however fairly costly. The stopping of the balls in the storage airlock or the passing thereof through the airlock without stopping is more often than not controlled by a motorized valve of a type that does not damage the balls. That is also where the worn balls are removed and the new balls are introduced. This device is also fairly costly.

For small exchangers such as those used in air conditioning installations, the industrial methods and the auxiliary circuits, there are a certain number of simplified systems that do however involve numerous motorized valves that are not very strong, often associated with one or more standard pumps where the balls do not pass because of the configuration of the circuit and the action of the controlled valves.

Objects and Summary

The present invention sets out to remedy at least one of the above drawbacks by proposing a cleaning installation of a heat exchanger, comprising:

- at least one heat exchanger linked, on the one hand, upstream to an intake duct for a fluid and, on the other hand, downstream to an outlet duct for the fluid,
- a system for recovering cleaning bodies from the fluid outlet duct after cleaning of said at least one exchanger by said cleaning bodies and for reinjecting said cleaning bodies into the fluid intake duct, characterized in that the system forms a unitary assembly comprising at least one member which is capable of being displaced between several positions, including:

- a first position in which the system is configured to recover and contain cleaning bodies in said at least one mobile member, and
- a second position in which the system is configured, on the one hand, to take fluid from the fluid intake duct and, on the other hand, reinject, into said fluid intake duct, via said at least one mobile member and under the action of the fluid taken, cleaning bodies contained in said at least one member.

The abovementioned installation comprises neither pump nor motorized valves on the circuit of the cleaning bodies, which makes the installation more reliable than previously. Indeed, the presence of motorized valves and their repeated implementation induces, over time, malfunctions which require maintenance operations.

Moreover, the abovementioned installation is less costly economically than an installation involving motorized valves, a pump, etc.

Furthermore, the displacement of a member and not of several valves, typically four, is simpler to manage (e.g.: no synchronization between the valves).

The system comprising said at least one mobile member forms a unitary assembly in as much as it is not composed of parts or components which are distributed in the installation at different points, notably on different links or hydraulic ducts. The unitary assembly forms a block or module (structural and functional unit) which can be transported in a single piece to be installed in the installation and coupled to different hydraulic links or ducts. The unitary assembly is capable of receiving and containing cleaning bodies for the period of an operation and for a position of said at least one member then of discharging all or some of these bodies from the system, for another position of said at least one member. The unitary assembly forms a kind of airlock which, depending on the position of said at least one mobile member, is capable of receiving and storing cleaning bodies originating from a collection zone of the installation or of discharging them to a reinjection zone of the installation.

It will be noted that other positions of said at least one mobile member can be envisaged, for example intermediate positions between the first position and the second position. These intermediate positions are generally only transitional (temporary) positions in which said at least one member does not stop except with regard to a position of rest in which the system is no longer connected with the outside of said system.

Generally, said at least one mobile member is hollow in order to be able to contain cleaning bodies.

According to Other Possible Features:

- the system comprises an enclosure (e.g.: external) which comprises several openings, each intended to be coupled to a hydraulic link external to said enclosure, said at least one member comprising several openings, and:

in the first position, said at least one member, on the one hand, blocks first openings of the enclosure in order to prevent any connection between the interior and the exterior of the enclosure via these first openings and, on the other hand, matches some of the openings of said at least one member with second openings of the enclosure in order to connect the interior and the exterior of the enclosure via these second openings, in the second position, said at least one member, on the one hand, matches other openings of said at least one member with the first openings of the enclosure in order to connect the interior and the exterior of the enclosure via these first openings and, on the other hand, blocks the second openings of the enclosure in order to prevent any connection between the interior and the exterior of the enclosure via these second openings; thus, the interior and the exterior of the enclosure are connected or not depending on the position of said at least one mobile member inside the enclosure and therefore on the matching or not of the openings of said at least one mobile member with those of the enclosure;

the system comprises a first hydraulic link with the fluid outlet duct, a second and a third hydraulic link with the fluid intake duct and a fourth hydraulic link for discharging fluid in the first position of said at least one member, said at least one member having openings which are capable of being connected with the first and fourth hydraulic links in the first position of said at least one member and with the second and third hydraulic links in the second position of said at least one member; said at least one mobile member acts as a kind of manifold which makes it possible, on command, to connect the interior of said at least one member with hydraulic links via openings in order to ensure a predetermined function of the system;

in the first position, the openings of said at least one member are not connected with the second and third hydraulic links;

in the second position, the openings of said at least one member are not connected with the first hydraulic link;

said at least one member is a sheath mounted to slide inside an enclosure or, alternatively, said at least one member is a cylinder mounted to pivot about an axis inside an enclosure;

the system comprises at least one actuator for displacing said at least one mobile member; the actuator can be of electrical, hydraulic, pneumatic, or other such type;

the installation further comprises a system for intercepting and collecting cleaning bodies circulating in the installation, this system being, for example, arranged on the fluid outlet duct.

Another subject of the invention is a system for recovering and reinjecting cleaning bodies for a heat exchanger, characterized in that the system forms a unitary assembly comprising an enclosure (e.g.: external) and at least one member which is mobile inside the enclosure, the enclosure comprising several openings each intended to be coupled to a hydraulic link external to said enclosure, said at least one member comprising several openings and being capable of occupying several positions inside the enclosure, including:

a first position in which said at least one member, on the one hand, blocks first openings of the enclosure in order to prevent any connection between the interior and the exterior of the enclosure via these first openings and, on the other hand, matches some of the openings of said at least one member with second openings of the enclosure in order to connect the interior and the exterior of the enclosure via these second openings, a second position in which said at least one member, on the one hand, matches other openings of said at least one member with the first openings of the enclosure in order to connect the interior and the exterior of the enclosure via these first openings and, on the other hand, blocks the second openings of the enclosure in order to prevent any connection between the interior and the exterior of the enclosure via these second openings; this system includes the same advantages as those mentioned above in relation to the installation and they will not therefore be repeated; such a system makes it possible, by a simple displacement (controlled or manual) of said at least one mobile member from one position to the other inside the enclosure, to ensure different functions on the cleaning bodies, instead of a set of motorized valves whose operation would be synchronized between the valves; this system is particularly efficient when compared to motorized valves;

the system can more particularly be characterized in that:

in the first position, the system is configured to recover cleaning bodies from a first fluid duct intended to be coupled to the enclosure and contain them in said at least one mobile member, and in the second position, the system is configured to, on the one hand, take fluid from a second fluid duct intended to be coupled to the enclosure and, on the other hand, reinject, into said second fluid duct, via said at least one mobile member and under the action of the fluid taken, cleaning bodies contained in said at least one mobile member.

According to Other Possible Features:

the system comprises a first hydraulic link intended to be coupled with the first fluid duct, a second and a third hydraulic links intended to be coupled with the second fluid duct and a fourth hydraulic link for discharging fluid in the first position of said at least one member, said at least one member having openings which are capable of being connected with the first and the fourth hydraulic links in the first position of said at least one member and with the second and third hydraulic links in the second position of said at least one member;

said at least one member is a sheath mounted to slide inside an enclosure or a cylinder mounted to pivot about an axis inside an enclosure;

the system comprises at least one actuator for displacing said at least one mobile member.

The system can also comprise all or some of the other features presented above in relation to the installation.

Also a subject of the invention is a method for recovering and reinjecting cleaning bodies for a heat exchanger in a system which forms a unitary assembly comprising an enclosure (e.g.: external) and at least one mobile member inside the enclosure, the enclosure comprising several openings each intended to be coupled to a hydraulic link external to said enclosure, said at least one member comprising several openings, the method comprising steps of displacement of said at least one member inside the enclosure in order for the latter to occupy several positions, including:

a first position in which said at least one member, on the one hand, blocks first openings of the enclosure in order to prevent any connection between the interior and the exterior of the enclosure via these first openings and, on the other hand, matches some of the openings of said at least one member with second openings of the enclosure in order to connect the interior and the exterior of the enclosure via these second openings, a second position in which said at least one member, on the one hand, matches other openings of said at least one member with the first openings of the enclosure in order to connect the interior and the exterior of the enclosure via these first openings and, on the other hand, blocks the second openings of the enclosure in order to prevent any connection between the interior and the exterior of the enclosure via these second openings.

BRIEF DESCRIPTION OF THE DRAWINGS

Other features and advantages will become apparent from the following description, given purely in a nonlimiting manner and with reference to the attached drawings, in which.

DETAILED DESCRIPTION

Figure 1:
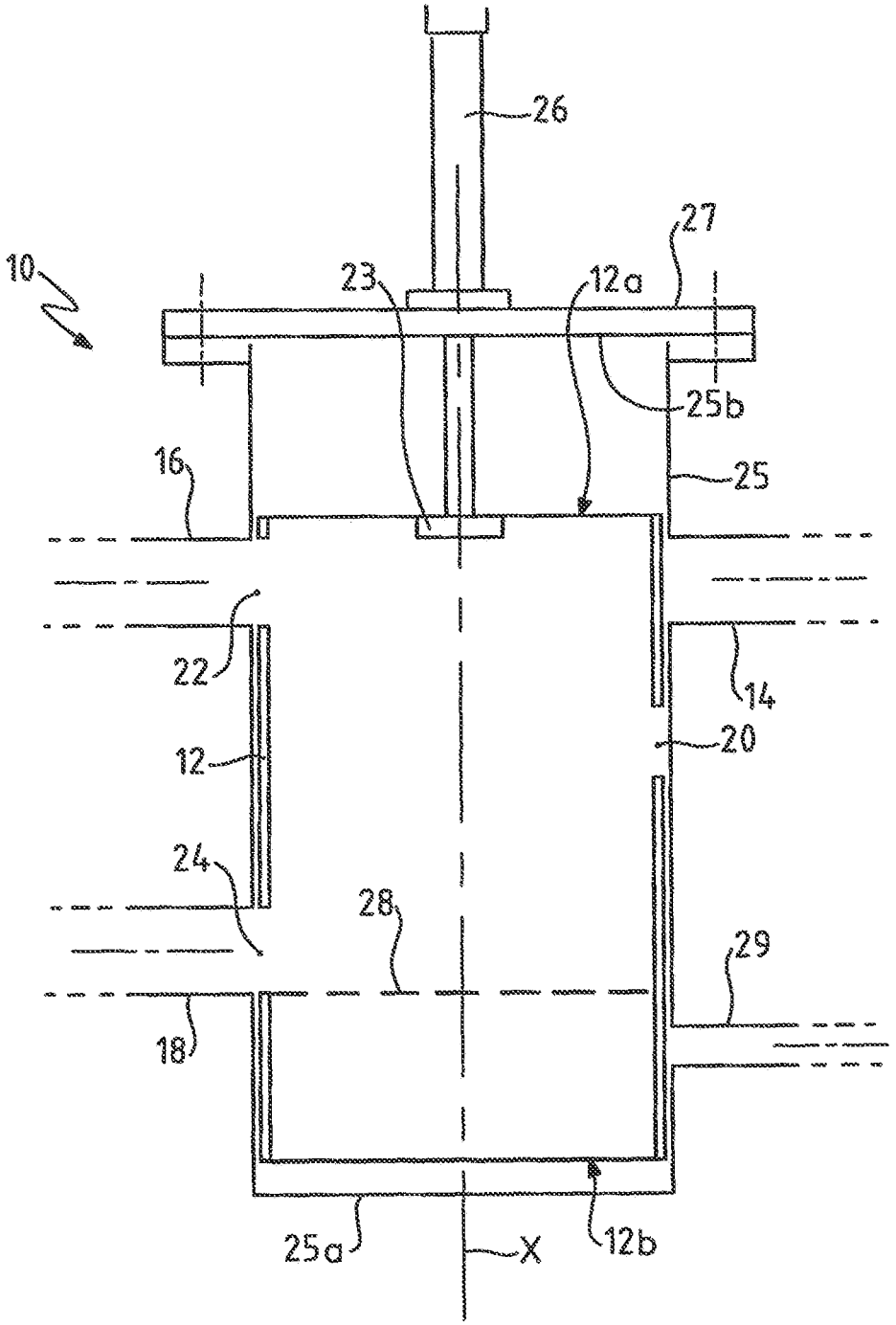
FIG. 1 is a schematic view of a system for recovering and reinjecting cleaning bodies according to an embodiment of the invention, the device being in cleaning body reinjection position.

FIG. 1 illustrates schematically and in isolation a system 10 for recovering and reinjecting cleaning bodies according to an embodiment of the invention.

In this embodiment, the cleaning bodies are solid cleaning elements that are known per se which are likely to be circulated permanently in the installation of FIG. 2 described hereinbelow and, in particular, in a heat exchanger of this installation, for the continuous cleaning thereof.

In practice, the cleaning bodies are balls of foam rubber, the diameter of which is slightly greater than the internal diameter of the tubes of the heat exchanger to be cleaned, and whose density, in the soaked state, is similar to that of water.

Figure 2:
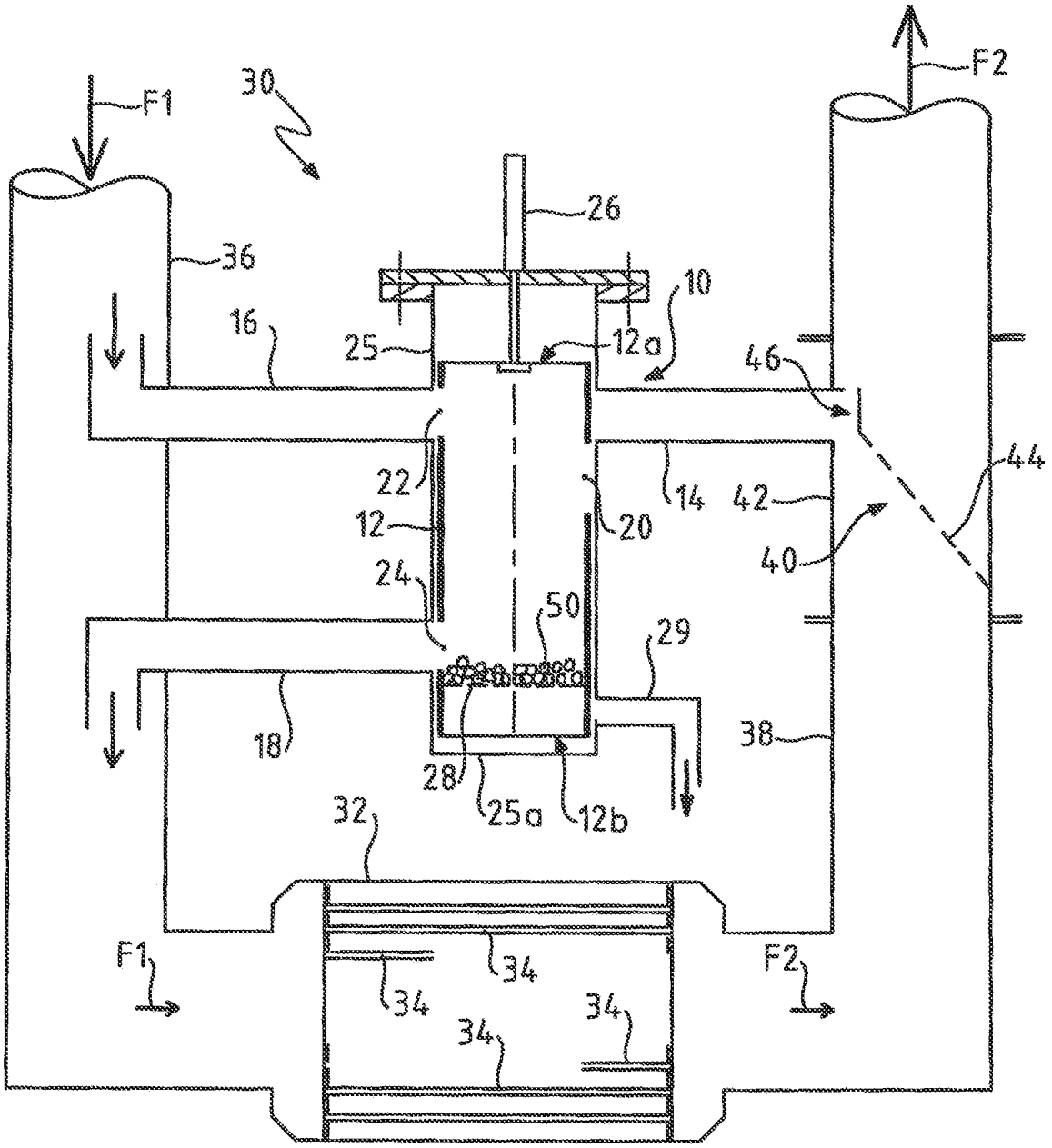
FIG. 2 is a general schematic view of a heat exchange installation according to an embodiment of the invention, comprising a heat exchanger and the system for recovering and reinjecting cleaning bodies of FIG. 1.

A management of these cleaning bodies should be provided, for example, in the installation of FIG. 2, that is to say not only an effective circulation thereof in the heat exchanger, but also control of the number thereof and possibly their dimensions (thus if necessary making it possible to eliminate the bodies which are too worn).

The system 10 exerts a number of functions on the cleaning bodies, namely their recovery in the installation after having performed the cleaning of the exchanger, and the reinjection of at least some bodies (in as much as they are not all replaced) for a new cleaning. This system forms a unitary assembly (structural and functional unit) located in a zone of the installation (for example between the two fluid intake and outlet ducts in FIG. 2) and which can take the form of a block or module that can be displaced in a single piece to be installed in the installation or removed therefrom.

To this end, the system 10 comprises at least one mobile member 12 (here, a single mobile member is used and represented) which is capable of being displaced between several positions, including:

- a first position in which the system is configured to recover and contain cleaning bodies in the mobile member 12 (stable position of FIG. 3), and
- a second position in which the system is configured to, on the one hand, take fluid from a fluid intake duct (not represented in FIG. 1) and, on the other hand, reinject, into said fluid intake duct, via the mobile member 12 and under the action of the fluid taken, cleaning bodies contained in the member (stable position of FIG. 1).

Generally, the system comprises an external enclosure or body 25 which comprises several openings each intended to be coupled to a hydraulic link external to said enclosure and the mobile member 12, which here is hollow to be able to contain cleaning bodies, comprises several openings.

In the first position of the system, the member, on the one hand, blocks first openings of the enclosure in order to prevent any connection between the interior and the exterior of the enclosure via these first openings and, on the other hand, matches some of the openings of the member with second openings of the enclosure in order to connect the interior and the exterior of the enclosure via these second openings.

In the second position of the system, the member, on the one hand, matches other openings of the member with the first openings of the enclosure in order to connect the interior and the exterior of the enclosure via these first openings and, on the other hand, blocks the second openings of the enclosure in order to prevent any connection between the interior and the exterior of the enclosure via these second openings.

Thus, depending on the position of the member in the enclosure, the interior of the enclosure (and in particular the interior of the member) and the exterior of the enclosure are connected via different openings of the enclosure and of the member which are matched together in order to ensure the functions mentioned above. The abovementioned openings are arranged at different points of the enclosure and of the member.

Figure 3:
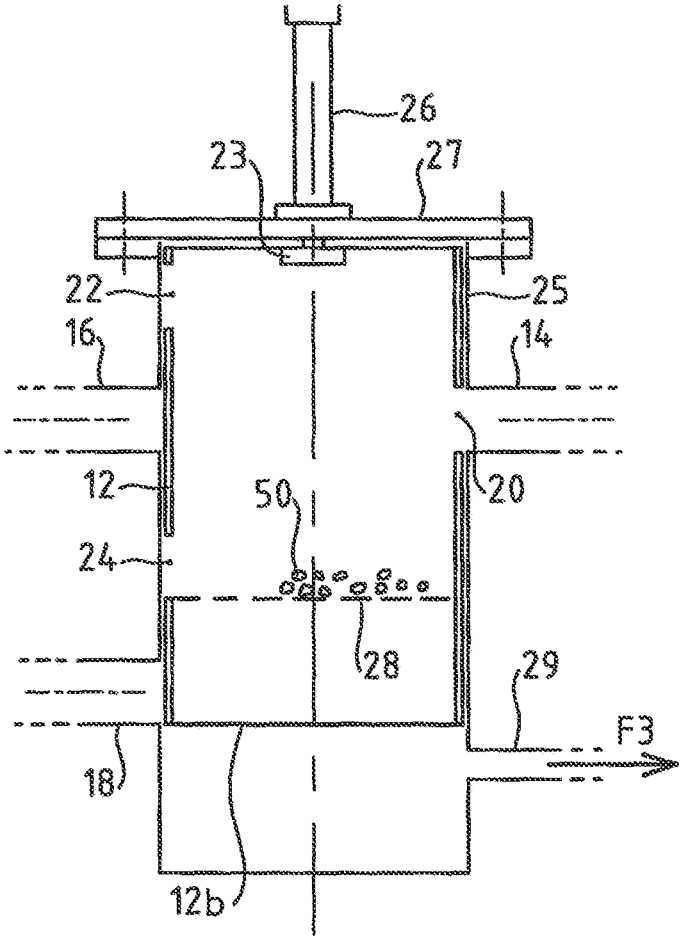
FIG. 3 is a schematic view of the system of FIG. 1 in cleaning body recovery position.

In this embodiment, the system 10 comprises a first hydraulic link or coupling 14 with a fluid outlet duct (not represented in FIG. 1) and a second 16 and a third 18 hydraulic link or coupling with the fluid intake duct. The system 10 also comprises a fourth hydraulic link 29 making it possible to discharge the water upon the recovery of the cleaning bodies (FIG. 3). The hydraulic link 29 is, for example, linked, in a way not represented, to the drain. The abovementioned hydraulic links each have an opening at each of their two opposite ends and in particular at the end of the link which is coupled to the enclosure 25. The latter openings are those which are matched with the openings of the member to allow the passage of the cleaning bodies and/or the fluid depending on the case and the position of the member.

The links are arranged according to different axial positions along the enclosure.

For the purposes of simplification, the hydraulic ducts, links or couplings are represented over only a part of their length.

The mobile member 12 has openings 20, 22, 24 which are capable of being connected respectively with the first hydraulic link 14 in the first position of the member (FIG. 3) and with the second 16 and third 18 hydraulic links in the second position of the member (FIG. 1).

More particularly, the mobile member 12 is displaced axially (along the axis X) inside the external enclosure 25 to which the various abovementioned hydraulic ducts or links are coupled to come, depending on the axial position, to block or leave free openings of the enclosure and the assembly (enclosure and member) forms a kind of dynamic airlock through which the cleaning bodies will pass.

Figure 4:
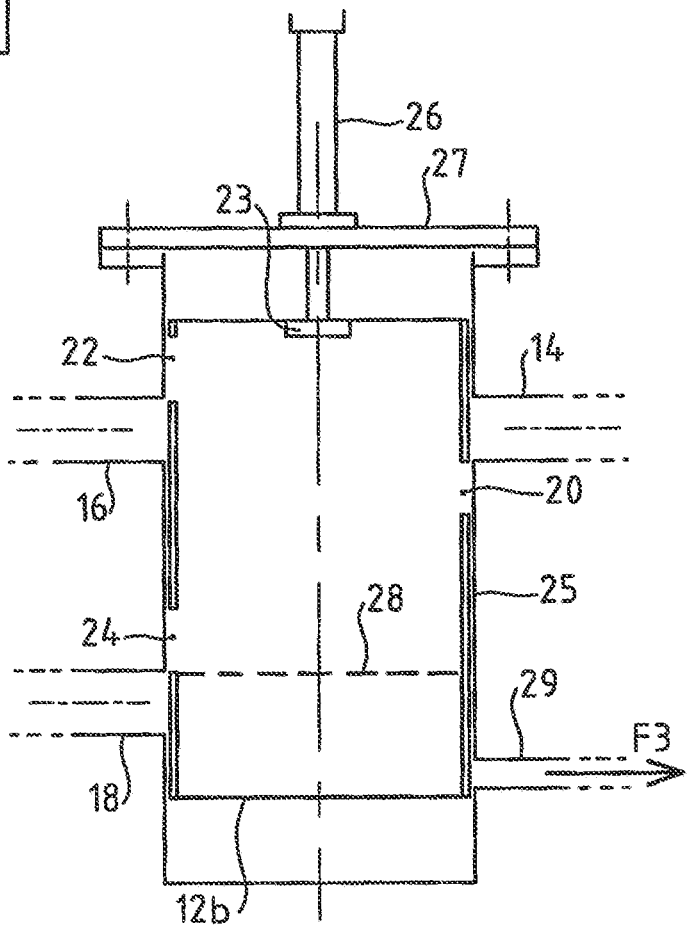
FIG. 4 is a schematic view of the system of FIG. 1 in position of rest.

The axial displacement is made possible by virtue of an actuation or driving device (this device is generally secured to the enclosure and therefore forms part of the unitary assembly formed by the system) such as an actuating drive 26 or any other mechanical mechanism/arrangement capable of producing a reciprocating (to and fro) axial translational movement in order to occupy, on command, any one of the positions of FIGS. 1, 3 and 4, even other positions. As an example, the actuating drive can be of pneumatic, hydraulic or electrical type.

Here, the mobile member 12 is a sheath mounted to slide in the enclosure 25 concentrically thereto.

According to variant embodiments not represented, the mobile member can take other forms of embodiment in order to be able to be displaced in a controlled manner and connect the interior of the mobile member (interior of the airlock and the enclosure) selectively with one or more links or ducts coupled to the enclosure in order to fulfil either a function of recovery of cleaning bodies, or a function of reinjection of these bodies.

The mobile member 12 of FIG. 1 is, here, open at its two opposite ends arranged along the axis X: at the end 12*a* arranged facing the driving device 26, and at the other end 12*b* which is open axially towards the bottom 25*a* of the body 25. The opening 12*b* is also considered as an opening of the member 12 which, depending on the position thereof inside the body 25, connects the interior of the member 12 with the discharge duct 29.

Moreover, the member 12 is open laterally to the outside through openings 20, 22, 24 already described and which are arranged at different axial positions one after the other along the member, in particular the sheath.

At the end 12*a*, arranged in the top part of FIG. 1, an attachment system 23 that is known per se for the actuator 26 is mounted on the member 12. A cover 27 is provided above the end 12*a* to close the body 25 at its end 25*b* opposite the bottom 25*a*. The actuator 26 is mounted on the cover 27 and passes through the latter, here via the rod of the actuating drive.

A grating 28 is arranged above the open end 12*b* and delimits with the latter a space (here bottom space) free of the openings 20, 22, 24 but which has the opening 12*b*. The cleaning bodies which will be recovered by the mobile member will be stopped by this grating which will allow the fluid to pass towards the bottom 25*a* via the opening 12*b* and the duct 29 when the member 12 has been displaced axially (FIG. 3).

It will be noted that the arrangement of the system 10 (or of any other system according to the invention ensuring the same functions but with a different structure; notably a system in which a mobile member is displaced inside an external enclosure or body to connect the interior of the mobile member and the exterior of the enclosure selectively with one or more links coupled to the enclosure) can adopt any position depending on the draining and venting capabilities: horizontal, inclined, or, on the contrary, vertical. In the horizontal position of the body 25, a vertical drain can for example be installed under said body 25. Since the cleaning bodies have a density close to that of water, gravity has in fact no significant impact on these bodies.

FIG. 2 schematically shows, under the general reference denoted 30, a cleaning installation according to an embodiment of the invention which comprises several elements including a condenser-forming heat exchanger 32 (in a variant embodiment not represented, the installation can comprise several heat exchangers). The exchanger 32 comprises several tubes 34 which are arranged so as to form a tube bundle. This is, in practice, a tubular exchanger which, for example, is of the type of that briefly described in the document FR 2 716 530. Since such an exchanger is well known in itself, and is not specifically a matter of the present invention, it will not be described more here.

As schematically represented by the arrows F1 and F2, this exchanger 32 is passed through by a flow of coolant, in this case water, with the help, on the one hand, of a cold fluid intake or fetching duct or pipeline 36 (input flow F1) and, on the other hand, of a reheated fluid outlet or discharge duct or pipeline 38 (output flow F2). In a variant, the exchanger can be of another type and the fluid brought by the duct 36 can be a hot fluid.

As is known per se, cleaning bodies are systematically injected into the inlet duct 36, to be driven by the incoming flow F1.

The installation 30 also comprises, mounted on the outlet duct 38, a system 40 for intercepting and collecting circulating cleaning bodies that is known per se. The system 40 comprises, for example, a trunking 42, a grating 44 and a body collection box 46 and is installed on the outlet duct 38. According to a variant not represented, any other system for intercepting and collecting cleaning bodies can be envisaged.

The system 10 of FIG. 1 (or any other system according to the invention ensuring the same functions but with a different structure; in particular a system in which a mobile member is displaced inside an external enclosure or body to connect the interior of the mobile member and the exterior of the enclosure selectively with one or more links coupled to the enclosure) is arranged between the two ducts 36 and 38 and is linked to the other elements of the installation 30, in particular to the ducts 38 and 36, via hydraulic links 14, 16 and 18 described above and represented in full in FIG. 2.

The two links or ducts 16 and 18 enter into the intake duct 36 upstream of the inlet of the exchanger 32: the duct 16 (second hydraulic link) is bent towards the upstream, for example at 90°, and emerges facing the flow $F_1$ in order to take a fraction of the fluid (the duct 16 forms an upstream tap), while the duct 18 (third hydraulic link) is bent towards the downstream, for example at 90°, and emerges in the direction of the flow $F_2$ in order to restore all or part of the fluid taken (the duct 18 forms a downstream tap). The ducts 14, 16, 18 are coupled in a sealed manner to the ducts 36 and 38. Alternatively, the arrangement of the ducts and their form can differ from the representation of FIG. 2.

Here, the ducts 16 and 18 are arranged on one side of the sheath while the duct 14 is arranged on the opposite side, as is the duct 29. However, any other arrangement of the ducts in relation to the sheath can be envisaged. As an example, the ducts 16 and 18 (with their openings emerging in the enclosure 25) and the corresponding openings of the sheath can be offset angularly relative to one another (e.g.: at 60 or 90°) and they can also be arranged at different heights from those illustrated in the figures. The duct 29 can also adopt a different angular orientation.

The collection box 46 is linked to the duct or branch-tee 14 (first hydraulic link). Practically, the ducts 14, 16, 18 and 29 are for example branch-tees coupled to the enclosure 25 of the airlock.

Operation of the Installation

The starting position of a cleaning cycle for the tubes of the exchanger 32 is illustrated in FIGS. 1 and 2. Cleaning bodies (balls) 50 have been previously stopped by the grating 28 and stored at this location in the sheath 12 as will be seen hereinbelow.

The actuating drive 26 positions the sheath 12 so that its axially offset openings 22 and 24 are facing the links 16 and 18 respectively (connection of the openings and emerging openings of the links), the links 14 and 29 being blocked by the outer wall of the sheath (the opening 20 is not connected with the link 14 and the opening 12*b* is not connected with the link 29).

The flow load created by the incoming flow $F_1$ in the duct 36 and the discharge by the outgoing flow $F_2$ of the duct 38 create a current in the installation.

The hydraulic thrust of the current in the cooling duct 36 on the tap 16 turned towards the upstream, added to the depression in the tap 18 turned towards the downstream, creates a rapid circulation of the water in the sheath 12.

The cleaning bodies 50 which were kept captive in the sheath against the grating 28 are driven via the link 18 in the cold water duct 36. The cleaning bodies 50 then run in the tubes 34 of the exchanger while cleaning them.

After a few seconds, all the cleaning bodies 50 contained in the sheath have been reinjected.

As soon as the cleaning bodies 50 have been reinjected into the duct 36, the actuating drive 26 brings the sheath to an axial position (FIG. 3) in which the links 16 and 18 are blocked (the openings 22 and 24 are no longer connected with the emerging openings of the links 16 and 18 which are then facing the outer wall of the sheath). The opening 20 is facing the link 14 (connected) and the link or branch-tee 29 is also open to the interior of the enclosure 25. The outer wall of the sheath 12 no longer forms a screen and the link 29 is connected with the interior of the enclosure 25 and with the interior of the sheath via the opening 12*b*.

In this position, the opening 12*b* is arranged above the link 29 (and no longer below as in FIGS. 1 and 2) and below the link 18. Other arrangements can however be envisaged.

In this position, the water of the box 46 of FIG. 2 is sucked by the link 14 and goes back into the sheath 12. The box 46 contains cleaning bodies intercepted by the system 40 and these bodies are conveyed by the water which is sucked into the airlock. The sucked water passes through the grating 28 where the bodies that it contains are stopped (point of collection or of interception of the bodies), leaves the sheath 12 through the opening 12*b* and re-emerges via the link 29 according to the arrow $F_3$, for example to the drain.

In this position, the cleaning bodies are thus recovered and stored in the airlock, ready to be injected once again.

If there is no desire to trigger a new cleaning cycle immediately, the sheath 12 can slide to an intermediate position of rest where all the exits from the airlock are blocked (FIG. 4): the openings of the sheath 12 are blocked by the outer wall of the body and the link 29 is facing the wall of the sheath.

In the prior art, similar cycles of recovery and of reinjection of cleaning bodies are performed by actuating sets of motorized valves present on the circuits circulating the bodies in the installation, which considerably reduces the life of such cleaning body recovery and reinjection systems. The absence of motorized valves and of pumps ensures the reliability of the system 10 by considerably reducing the maintenance operations.

The system according to the invention does not require synchronization as is the case with several motorized valves.

The system according to the invention, in particular the system 10 (or any other system according to the invention ensuring the same functions but with a different structure; in particular, a system in which a mobile member is displaced inside an external enclosure or body to connect the interior of the mobile member and the exterior of the enclosure selectively with one or more links coupled to the enclosure), applies, generally, to a heat exchange installation comprising an exchanger coupled to fluid intake and outlet ducts and a system for intercepting and collecting cleaning bodies (this system can be different from the system 40 of FIG. 2).

It applies also to an installation which comprises several exchangers in parallel or in series, the configuration of the intake and outlet ducts coupled to the exchangers being adapted accordingly.

Generally, the system according to the invention, in particular the system 10, applies to all sizes of tubular exchangers in as much as the body of the system is dimensioned to contain the load of cleaning bodies necessary for the cleaning.

It will be noted that all the explanations provided above in relation to a sheath sliding in an external enclosure can be applied to any other mobile member capable of fulfilling the same functions, as well as to any other device for actuating this mobile member.

The numbers, forms and arrangements of the openings for connecting the interior of the member with the external hydraulic links can vary.

Figure 5:
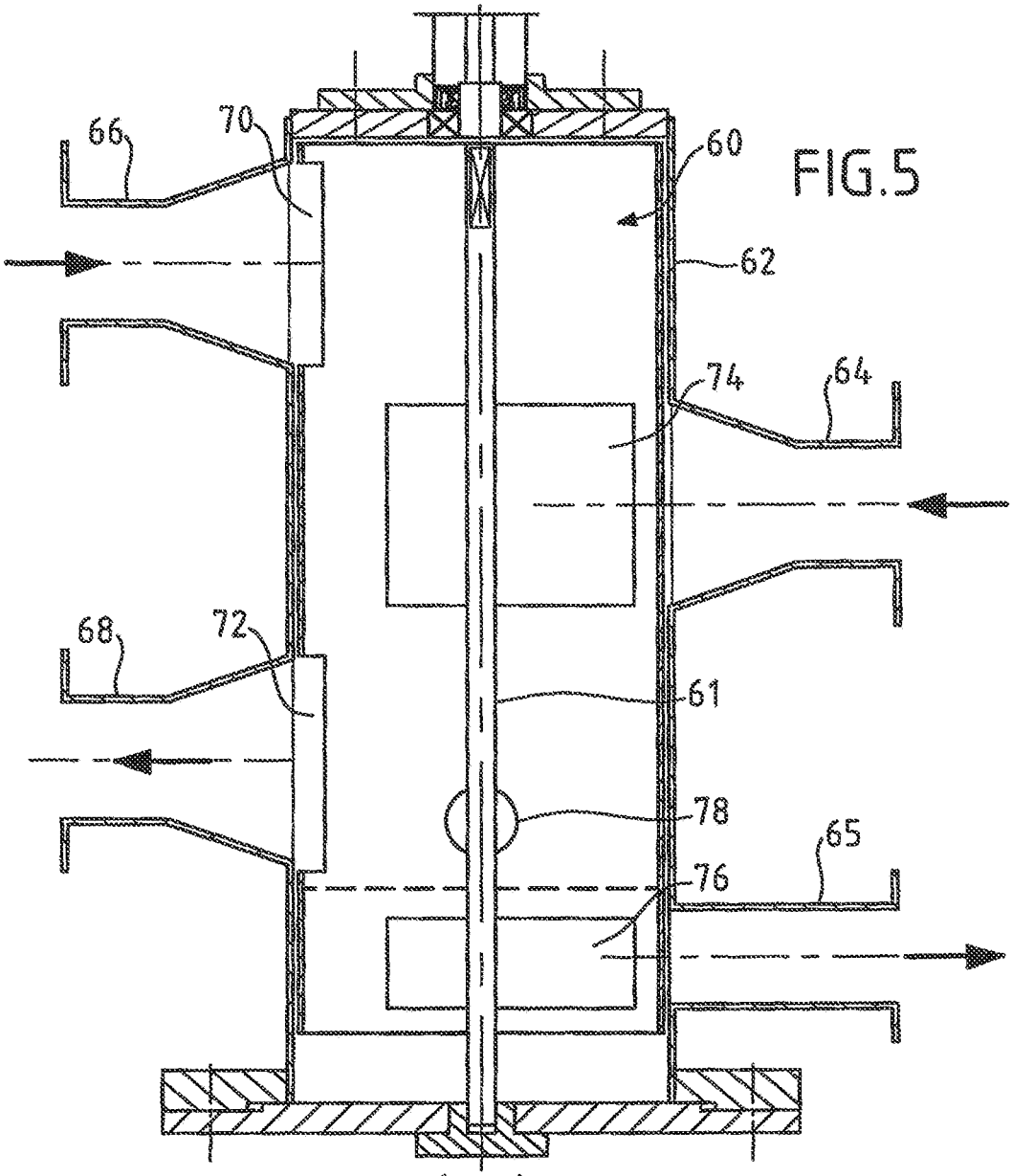
FIGS. 5 and 6 are schematic views of a system for recovering and reinjecting cleaning bodies according to another embodiment of the invention.
Figure 6:
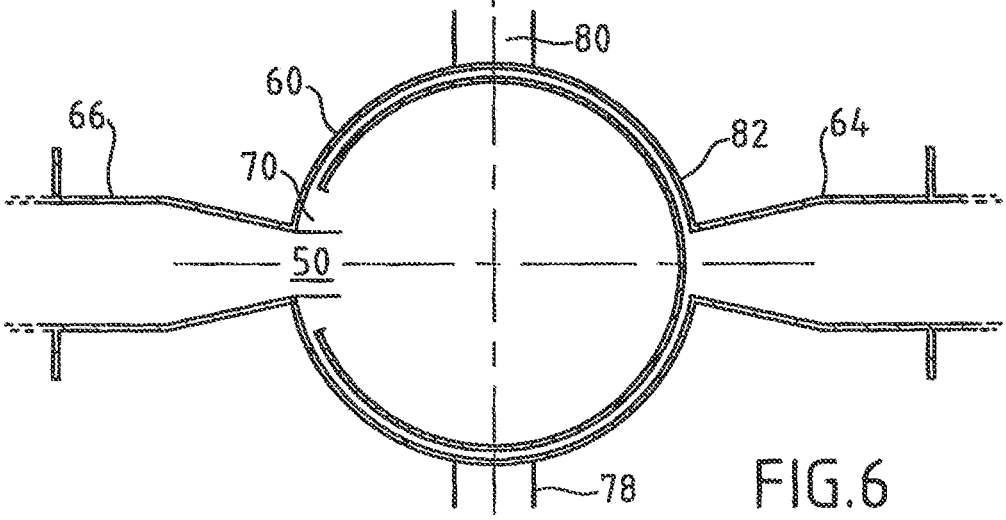

According to another embodiment illustrated in FIGS. 5 and 6, a pivoting cylinder 60 replaces the sliding cylindrical sheath of FIGS. 1 to 4. The cylinder 60 is mounted to pivot about an axis 61 inside a fixed body or enclosure 62 to which hydraulic links 64, 66, 68, 65 respectively serving the same purpose as the links 14, 16, 18, 29 of FIG. 2 are fixedly coupled. The system of FIGS. 5 and 6 applies for example to the installation of FIG. 2.

The pivoting cylinder 60 actuated by an appropriate device (reducing gear motor or similar) comprises, like the sheath 12, openings or orifices which are arranged in the wall of the cylinder in an axially and angularly offset manner (according to a transverse cross-sectional view of the cylinder) in order:

- in a position represented in FIG. 5, for openings 70, 72, for example arranged one on top of the other, to be positioned facing the links 66 and 68 respectively, the other, axially and angularly offset openings 74, 76 being blocked by the wall of the body 62 (function of reinjection of the cleaning bodies equivalent to the position of FIGS. 1 and 2),
- in another position not represented (equivalent to the position of FIG. 3), for the openings 74, 76 to be respectively facing the links 64 and 65 (discharging, for example, to the drain) which are axially offset relative to the links 66 and 68, while the openings 70 and 72 are blocked by the wall of the body 62.

A drain 78 has been represented for draining the cleaning bodies from the system, for example when it is installed in the horizontal position. However, other positions can also be envisaged for the system of FIGS. 5 and 6. As represented in FIG. 6, a vent (for filling the system with cleaning bodies) is also provided, for example above the body 62 (here diametrically opposite the drain 78).

Generally, the openings of the different hydraulic links are opened or closed by the offsetting of the openings on the cylinder, combined with the rotation of said cylinder so as to create either the circulation of cold water which drives the cleaning bodies, or the circulation of hot water to the drain which collects them.

A position of the cylinder in which all the openings are closed (position of rest) can also be provided.

It will be noted that everything which has been stated regarding the embodiment of FIGS. 1 to 4 applies equally to the embodiment of FIGS. 5 and 6 and will not be repeated here.

The invention claimed is:

1. A cleaning installation, for the cleaning of at least one heat exchanger that is linked, on one side, upstream to an intake duct for a fluid and, on another side, downstream to an outlet duct for the fluid, said cleaning installation comprising:

system for recovering cleaning bodies in the fluid outlet duct after cleaning of said at least one heat exchanger by said cleaning bodies and for reinjecting said cleaning bodies into the fluid intake duct, wherein the system forms an assembly having at least one mobile member which is capable of being moved between several positions, including:

a first position in which the system is configured to recover and contain cleaning bodies in said at least one mobile member, and a second position in which the system is configured, to take fluid from the fluid intake duct and, reinject, into said fluid intake duct, via said at least one mobile member and under the action of the fluid taken, cleaning bodies contained in said at least one member, wherein said at least one mobile member is a sheath mounted to slide inside an enclosure.

2. The cleaning installation according to claim 1, wherein the enclosure comprises several openings, each opening coupled to a hydraulic link external to said enclosure, said at least one member comprising first and second openings, and:

in the first position, said at least one member, blocks said first openings of the enclosure in order to prevent any connection between the interior and the exterior of the enclosure via said first openings and, matches some of the first and second openings of said at least one member with said second openings of the enclosure in order to connect the interior and the exterior of the enclosure via the second openings, in the second position, said at least one member, matches other of said first and second openings of said at least one member with the first openings of the enclosure in order to connect the interior and the exterior of the enclosure via said first openings and, blocks the second openings of the enclosure in order to prevent any connection between the interior and the exterior of the enclosure via said second openings.

3. The cleaning installation according to claim 1, wherein the system comprises a first hydraulic link with the fluid outlet duct, a second and a third hydraulic link with the fluid intake duct, and a fourth hydraulic link for discharging fluid in the first position of said at least one member, said at least one member having a first opening which is capable of being connected with the first hydraulic link in the first position of said at least one member, wherein the first position of the at least one mobile member allows for fluid connection between the interior of the at least one mobile member and the fourth hydraulic link and having second openings capable of being connected with the second and third hydraulic links in the second position of said at least one mobile member.

4. The cleaning installation according to claim 3, wherein, in the first position, openings of said at least one member are not connected with the second and third hydraulic links.

5. The cleaning installation according to claim 3, wherein, in the second position, openings of said at least one member are not connected with the first hydraulic link.

6. The cleaning installation according to claim 1, wherein the system comprises at least one actuator for displacing said at least one mobile member.

7. A system for recovering and reinjecting cleaning bodies in a heat exchanger, the system comprising:

an assembly having an enclosure and at least one member which is mobile inside the enclosure, the enclosure having first and second openings, each coupled to a hydraulic link external to said enclosure, said at least one member having first and second openings and being capable of occupying several positions inside the enclosure, including:

a first position in which said at least one mobile member, blocks first openings of the enclosure in order to prevent any connection between the interior and the exterior of the enclosure via said first openings and, matches some of the first and second openings of said at least one mobile member with the second openings of the enclosure in order to connect the interior and the exterior of the enclosure via the second openings, a second position in which said at least one member, matches other of said first and second openings of said at least one mobile member with the first openings of the enclosure in order to connect the interior and the exterior of the enclosure via the first openings and, blocks the second openings of the enclosure in order to prevent any connection between the interior and the exterior of the enclosure via these second openings, wherein:

in the first position, the system is configured to recover cleaning bodies from a first fluid duct coupled to the enclosure and contain them in said at least one mobile member, and in the second position, the system is configured to, take fluid from a second fluid duct coupled to the enclosure and, reinject, into said second fluid duct, via said at least one mobile member and under the action of the fluid taken, cleaning bodies contained in said at least one mobile member, and wherein said at least one mobile member is a sheath mounted to slide inside the enclosure.

8. The system according to claim 7, wherein the system comprises a first hydraulic link coupled to a fluid outlet duct, a second and a third hydraulic link coupled with a fluid intake duct, and a fourth hydraulic link for discharging fluid in the first position of said at least one member, said at least one member having openings which are capable of being connected with the first hydraulic links in the first position of said at least one member and with the second and third hydraulic links in the second position of said at least one member.

9. The system according to claim 7, wherein the system comprises at least one actuator for displacing said at least one mobile member.

10. A method for recovering and reinjecting cleaning bodies in a heat exchanger via a coupled system, the system being an assembly having an enclosure and at least one mobile member inside the enclosure, the enclosure having first and second openings each coupled to a hydraulic link external to said enclosure, said at least one member having first and second openings, the method comprising steps of:

displacement of said at least one mobile member inside the enclosure in order for the mobile member to occupy several positions, including:

a first position in which said at least one mobile member, blocks first openings of the enclosure in order to prevent any connection between the interior and the exterior of the enclosure via said first openings and, matches some of the openings of said at least one mobile member with the second openings of the enclosure in order to connect the interior and the exterior of the enclosure via said second openings, a second position in which said at least one mobile member, matches other openings of said at least one member with the first openings of the enclosure in order to connect the interior and the exterior of the enclosure via said first openings and, blocks the second openings of the enclosure in order to prevent any connection between the interior and the exterior of the enclosure via said second openings, wherein said at least one mobile member is a sheath mounted to slide inside the enclosure.

* * * * *